US006296518B1

(12) United States Patent
Avery et al.

(10) Patent No.: US 6,296,518 B1
(45) Date of Patent: Oct. 2, 2001

(54) STACKED ELECTRICAL CONNECTOR ASSEMBLY

(75) Inventors: Hazelton P. Avery, Batavia; Emanuel G. Banakis, Naperville; Eric Scharping, Lisle, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/552,242

(22) Filed: Apr. 19, 2000

(51) Int. Cl.[7] ..... H01R 13/60; H01R 13/66; H01R 13/648

(52) U.S. Cl. ..... 439/541.5; 439/607

(58) Field of Search ..... 439/541.5, 533, 439/567, 571, 74, 79, 80, 607

(56) References Cited

U.S. PATENT DOCUMENTS 5,500,788 * 3/1996 Longueville ..... 361/800
5,980,320 * 11/1999 Slack et al. ..... 439/607
6,159,040 * 9/1999 Chang et al. ..... 439/541.5

* cited by examiner

*Primary Examiner*—Brian Sircus
*Assistant Examiner*—Chandrika Prasad
(74) *Attorney, Agent, or Firm*—A. A. Tirva

(57) ABSTRACT

A system is provided for mounting a plurality of electrical connectors to a printed circuit board in a stacked array. At least a pair of electrical connectors include at least a top connector and a bottom connector adapted for mating with a pair of complementary mating connectors. At least one dual-function ESD frame member mounts the top connector to the printed circuit board above the bottom connector. The frame member also is conductive for grounding to the printed circuit board and includes an integral ESD portion for engaging an appropriate ground portion of a respective one of the mating connectors mateable with the top connector.

22 Claims, 6 Drawing Sheets

STACKED ELECTRICAL CONNECTOR ASSEMBLY

FIELD OF THE INVENTION

This invention generally relates to the art of electrical connectors and, particularly, to a system for mounting a plurality of stacked connectors on a printed circuit board.

BACKGROUND OF THE INVENTION

Electrical connectors are used in a wide variety of applications ranging from simple connecting interfaces between hard conductor wiring to more sophisticated applications involving such components as printed circuit boards, flat flexible cables and optical fibers. Basically, electrical connectors include some form of contacts, terminals or other conductors which interconnect one electrical device to another electrical device. The electrical connectors may involve systems whereby the connectors provide receiver-transmitter functions which, in addition, can convert high speed signals from solid (copper) cables or fiber optic cables to high speed signals on a system printed circuit board.

For instance, in the telecommunications industry, switching systems or circuitry may be provided on a rather sizable mother board at a particular location. A plurality of high speed electrical converter modules are mounted by appropriate frame structures on the mother board. Mating "plug-in" connector modules are plugged into the converter modules from outside the switching system. The incoming signals from the cables attached to the plug-in modules are at high speed, such as in the gigabit range, and the converter modules transfer and maintain the signals at high speed and transmit them to the circuitry on the mother board. Continuing problems have been encountered in the design and manufacturability of such systems.

In particular, there are applications in which it is desirable or necessary to mount a plurality of electrical connectors on a printed circuit board in a "stacked" array. In other words, one connector is mounted above another connector. With such connector assemblies, some form of frame structure must be provided to support the top or upper connector or connectors above the lower connector or connectors. Leads are provided from the upper connectors to the lower connectors or to the mother board, and the leads often are provided by flat flexible circuits which are relatively expensive. Still further, grounding systems or electrostatic discharge (ESD) systems must be incorporated in such assemblies. These requirements cause design problems because of the multiplicity of components required to provide all of the necessary functions, as described above. The present invention is directed to solving these problems by providing a simple system which is cost effective to manufacture, assemble and use, and a system which includes certain components performing multiple functions to eliminate some of the components of the prior art.

SUMMARY OF THE INVENTION

An object, therefore, of the invention is to provide a new and improved system for mounting a plurality of electrical connectors on a printed circuit board in a stacked array, i.e., with one connector mounted above another connector.

In the exemplary embodiment of the invention, the system includes at least a pair of electrical connectors including at least a top connector and a bottom connector for mating with a pair of complementary mating connectors. Each of the top and bottom connectors includes a plurality of terminals for engagement with appropriate terminals of the respective mating connector and for connection to the printed circuit board. At least one dual-function ESD frame member is provided for mounting the top connector to the printed circuit board, with the top connector positioned above the bottom connector. The frame member also is conductive for grounding to the printed circuit board and includes an integral ESD portion for engaging an appropriate ground portion of the respective one of the mating connectors mateable with the top connector. Therefore, the single frame member performs dual functions of both supporting the top connector as well as providing an ESD grounding means therefore.

As disclosed herein, the top connector is elongated, and a pair of the ESD frame members are provided at opposite ends of the top connector. The frame members are stamped and formed of sheet metal material, and the integral ESD portions thereof comprise resilient arms extending in the mating direction of the top connector. The ESD frame members also mount the bottom connector to the printed circuit board and include second integral ESD arms for engaging an appropriate ground portion of a respective one of the mating connectors mateable with the bottom connector.

Another feature of the invention is that each ESD frame member includes at least one tail portion for insertion into a hole in the printed circuit board. The tail portion, itself, performs dual functions of (a) mounting the ESD frame member and the top connector to the circuit board and (b) grounding the frame member to an appropriate location on the circuit board.

Another feature of the invention includes the provision of a lead frame for connecting the terminals of the top connector to the printed circuit board. The lead frame includes a plurality of leads having contact ends engageable with the terminals of the top connector and terminating ends engageable with the printed circuit board. The contact ends of the leads are overmolded by a housing which has a plurality of openings within which the contact ends of the leads are exposed. The terminals of the top connector have portions extending into the openings for engaging, as by soldering, the contact ends of the leads exposed in the openings.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
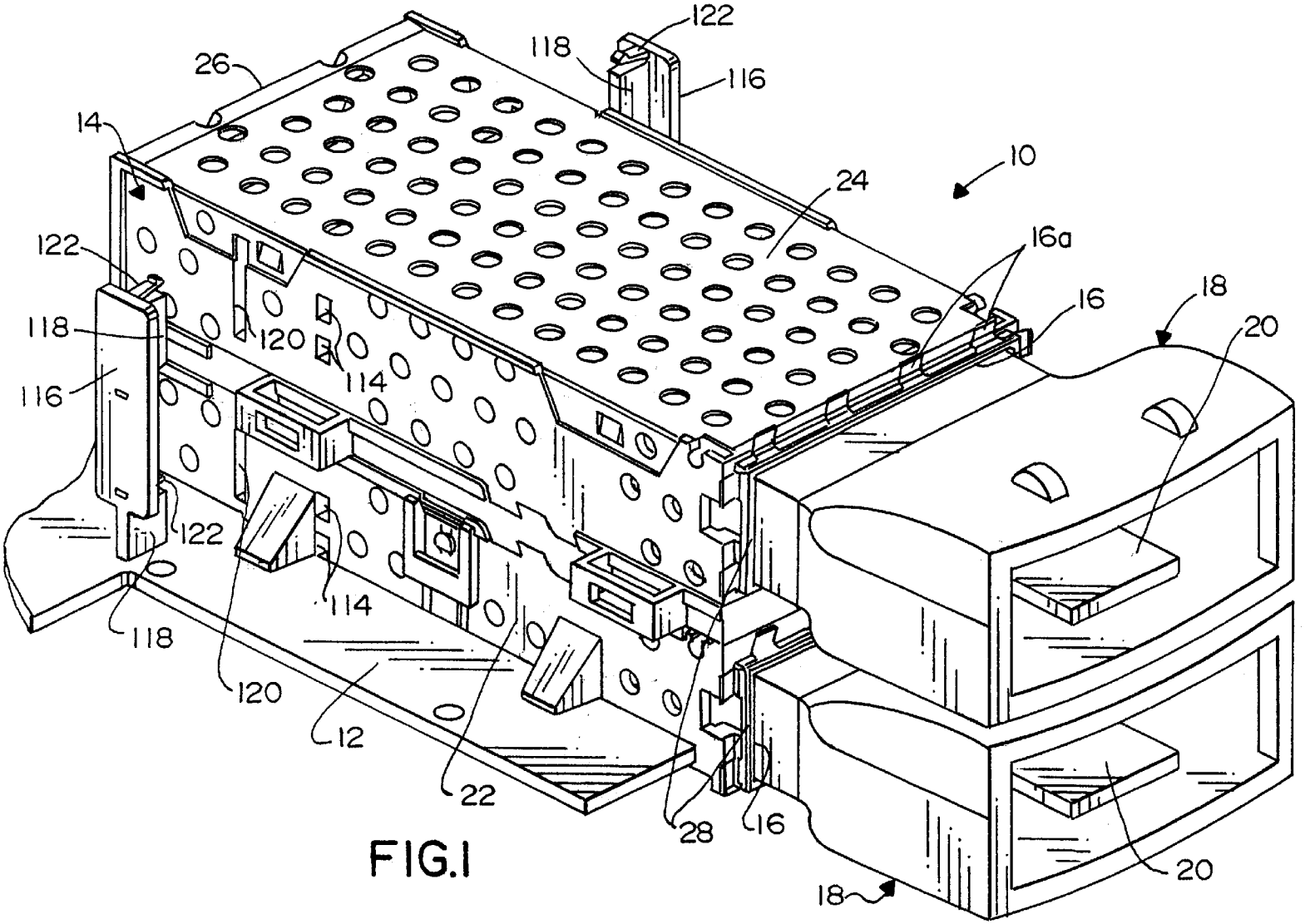
FIG. 1 is a front perspective view of an electrical connector assembly incorporating the concepts of the invention.
Figure 2:
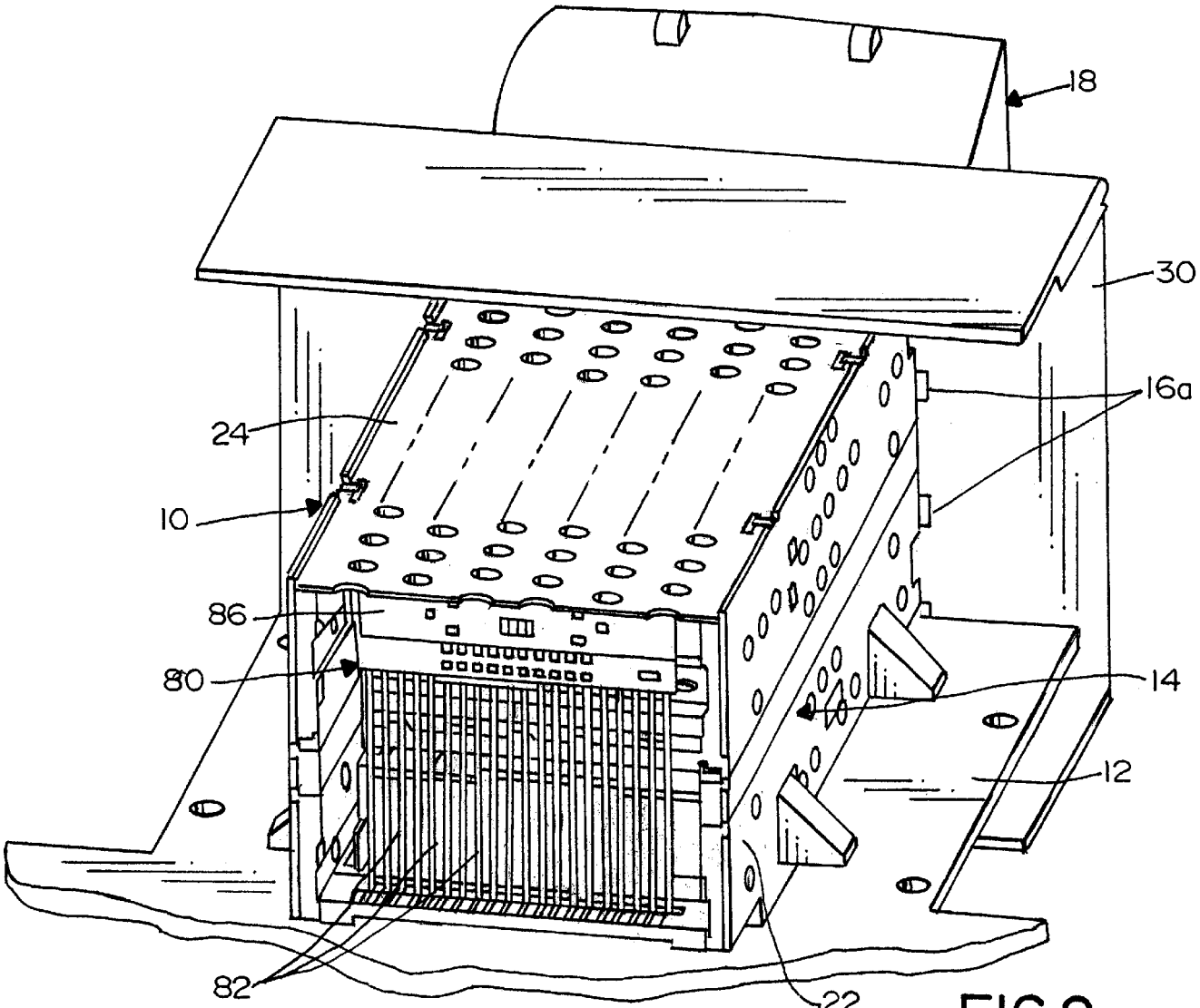
FIG. 2 is a rear perspective view of the assembly extending through a base frame, and with the rear cover of the assembly removed to show the interior thereof.

Referring to the drawings in greater detail, and first to FIGS. 1 and 2, the invention is embodied in an electrical connector assembly, generally designated 10, mounted on a printed circuit board 12 and including a casing, generally designated 14, defining a pair of front receptacles or openings 16 for receiving a pair of complementary mating connectors, generally designated 18, in a stacked array. In other words, mating connectors 18 are arranged with one connector mounted above the other connector. Each of the mating connectors includes a narrow, elongated connecting circuit board 20. Therefore, circuit board 12 can be considered the "mother" board in the overall connector assembly.

Casing 14 of connector assembly 10 includes a pair of diecast side walls 22, a stamped and formed sheet metal top wall 24 and a stamped and formed sheet metal rear wall or cover 26. Top wall 24 and rear cover 26 provide EMI protection for the assembly. The assembly also includes a lower shield 27 between mating connectors 18 to minimize interference between the upper and lower mating connectors. A pair of EMI gaskets 28 surround openings 16 which receive mating connectors 18. FIG. 2 shows the assembly mounted behind a base frame 30 which may comprise a metal or grounded chassis. EMI gaskets 28 have outwardly projecting tabs 16*a* for engaging the back side of base frame 30.

Figure 3:
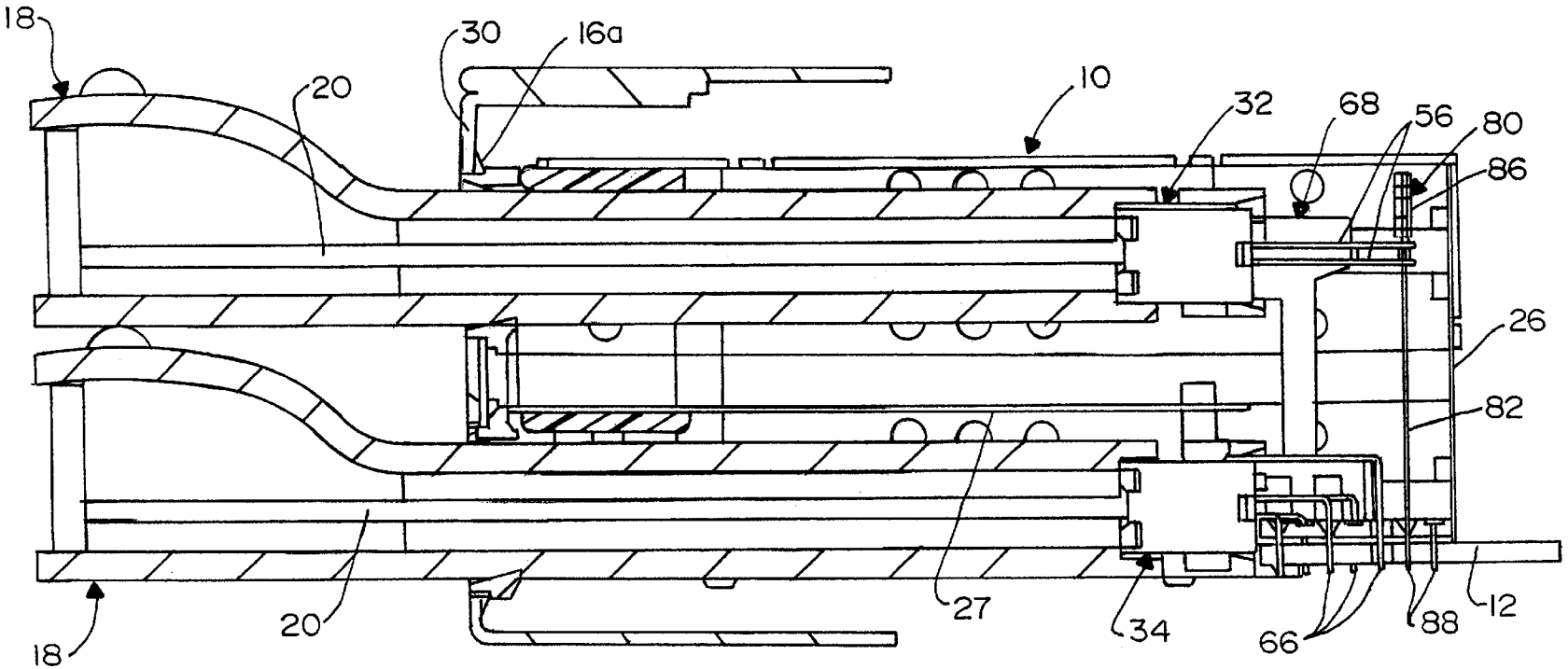
FIG. 3 is a front-to-rear section through the connector assembly.

FIG. 3 shows a front-to-rear section through connector assembly 10 mounted to printed circuit board 12 behind base frame 30 and receiving mating connectors 18. It can be seen that the narrow elongated connecting circuit boards 20 of the mating connectors extend rearwardly into the connector assembly and into a pair of electrical connectors, generally designated 32 and 34. The electrical connectors are mounted in a stacked array with one connector mounted above the other connector. Therefore, in the stacked array, connector 32 will be considered the top connector herein and connector 34 will be considered the bottom connector herein. Of course, the use of the terms "top", "bottom", "upper", "lower" and the like herein and in the claims hereof are not intended in any way to be limiting, because the connector assembly is omnidirectional in use and function.

Figure 4:
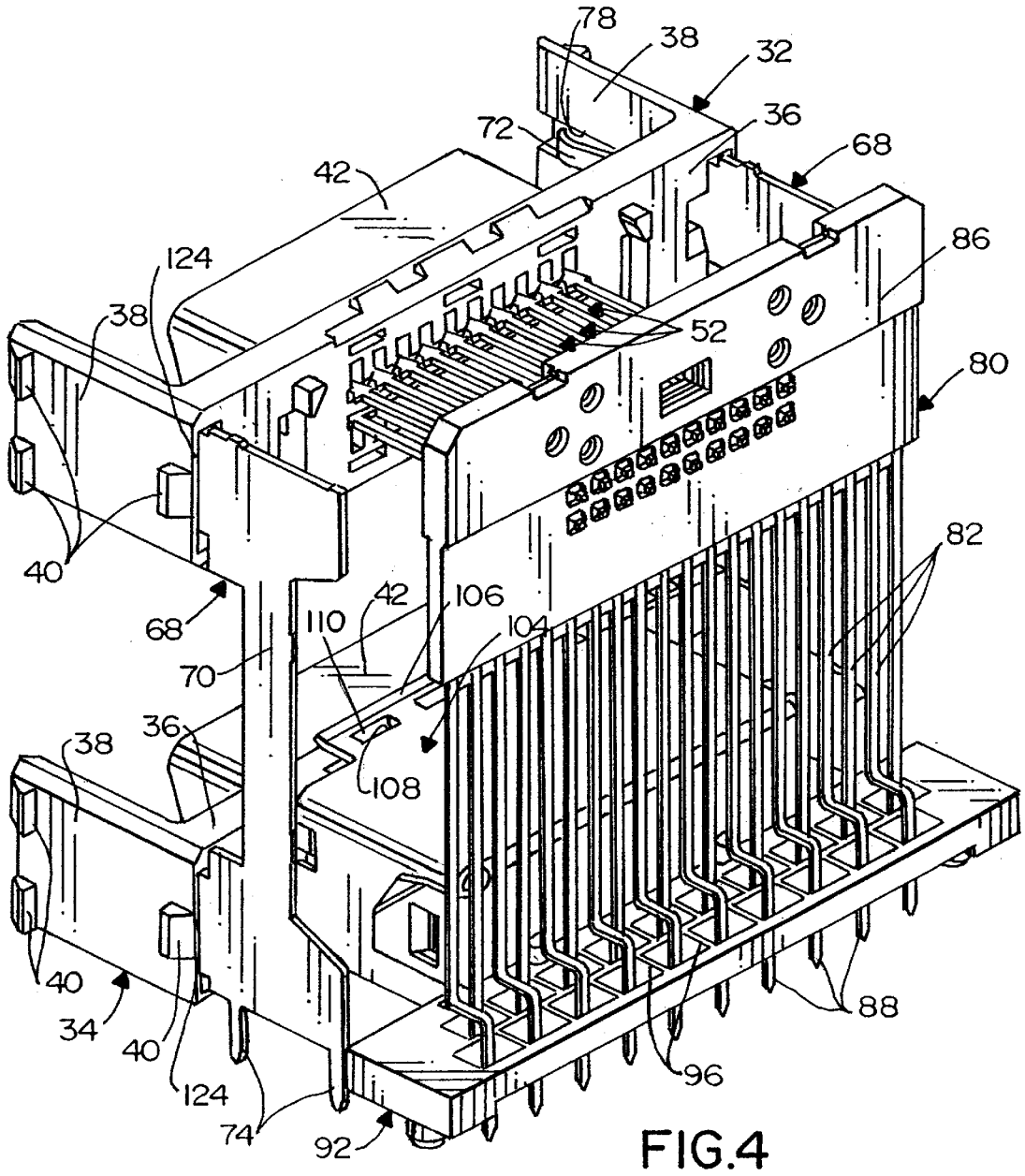
FIG. 4 is an enlarged rear perspective view of the stacked connectors within the assembly.
Figure 5:
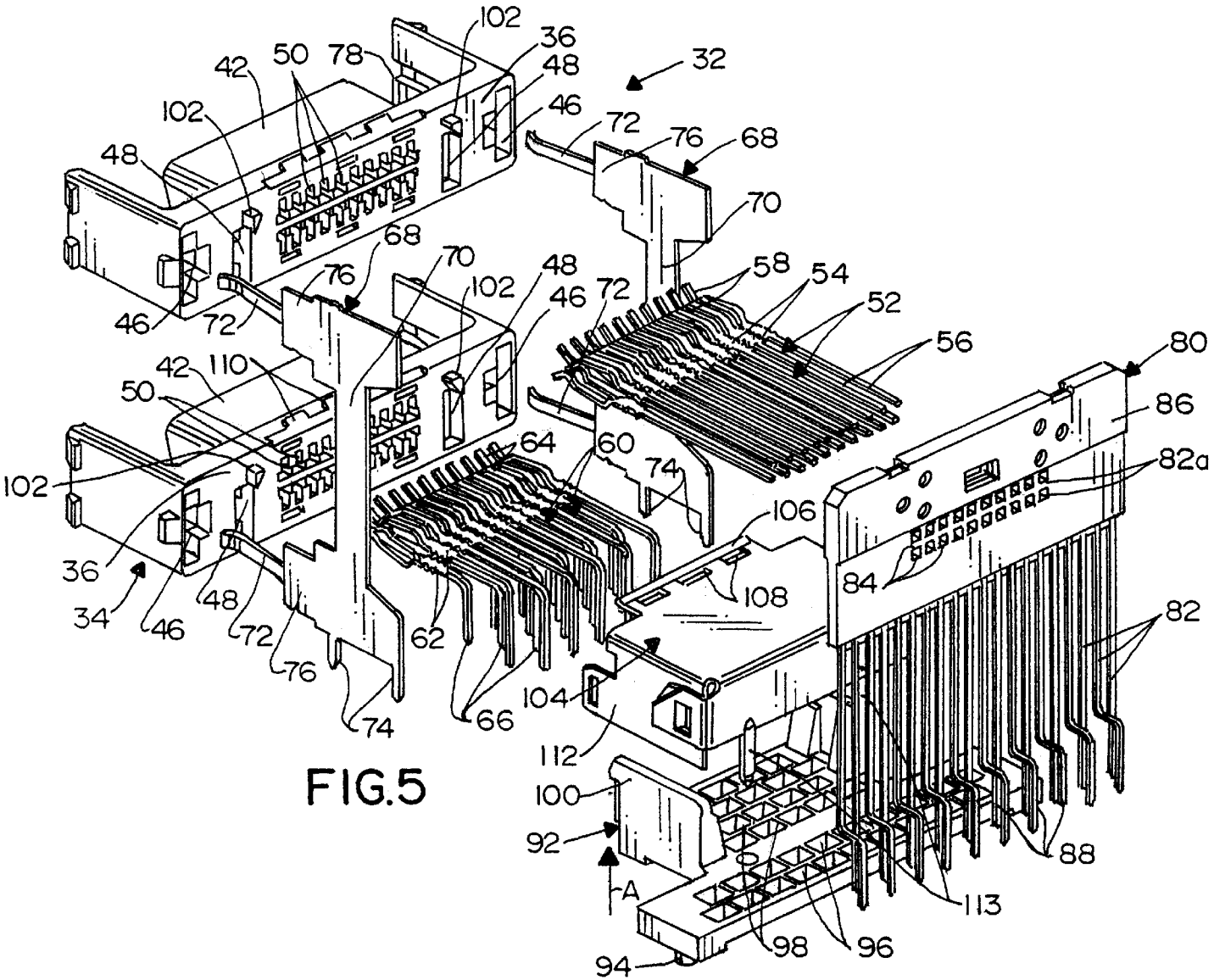
FIG. 5 is an exploded perspective view of the components shown in FIG. 4.
Figure 6:
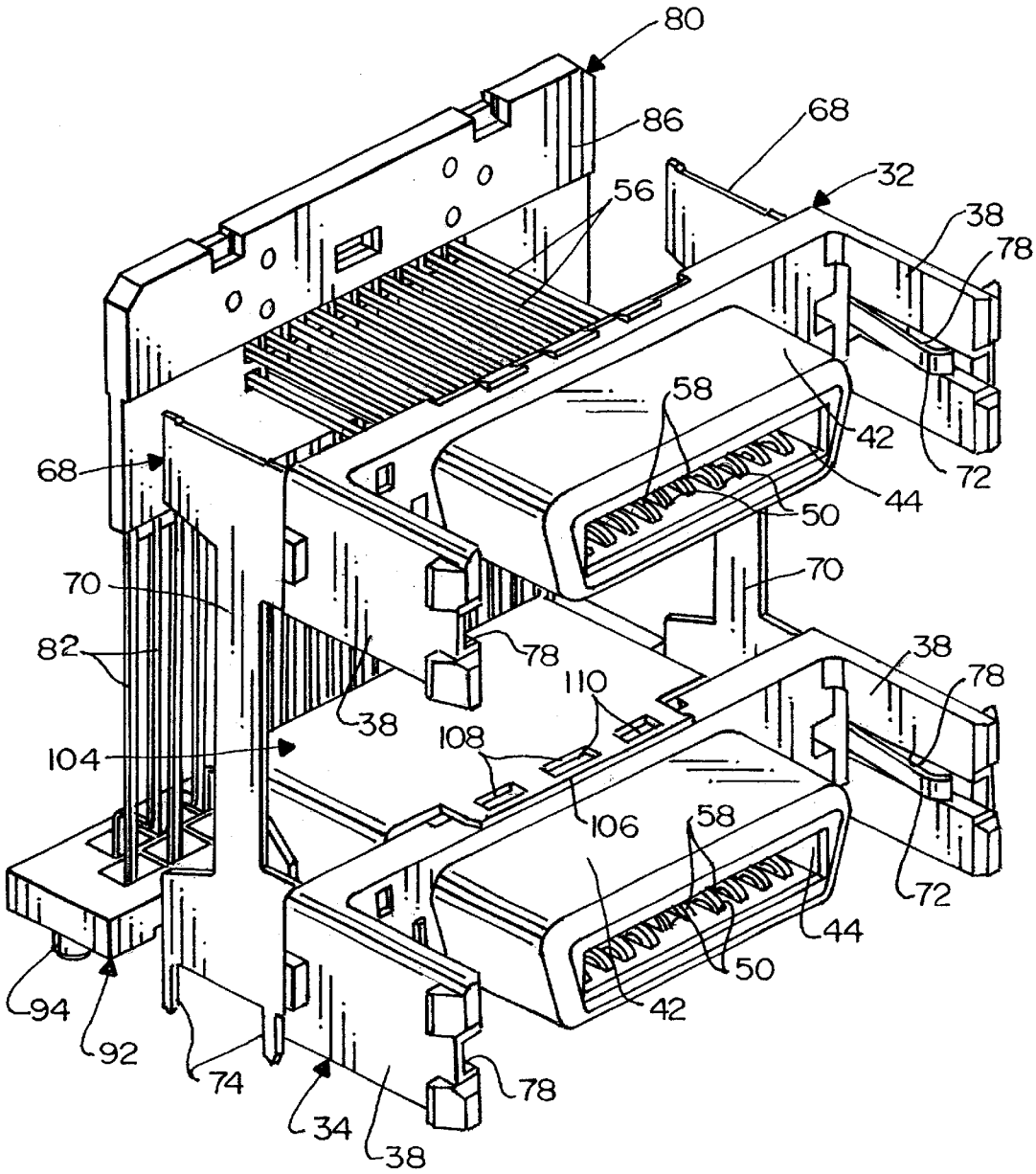
FIG. 6 is a front perspective view of the components as shown in FIG. 4.

With that understanding, reference now is made to FIGS. 4–6 which show the principal features of the invention. Specifically, top connector 32 is shown mounted above bottom connector 34 in the stacked array. Each connector includes a one-piece dielectric housing 36 which may be molded of plastic material or the like. Each housing includes a pair of side wings 38 having outside latch bosses 40 for mounting between side walls 22 of casing 14 of connector assembly 10 (FIG. 1). However, it should be understood that the entire subassembly shown in FIGS. 4–6 is assembled as a unit prior to mounting the subassembly onto mother board 12 and within casing 14 of connector assembly 10.

Each housing 36 of top and bottom connectors 32 and 34, respectively, is elongated and includes an elongated mating portion 42 projecting forwardly into the connector assembly. The mating portion includes a slot or receptacle 44 (FIG. 6) for receiving the inner end of connecting circuit board 20 of a respective one of the mating connectors 18. As best seen in FIG. 5, a pair of outside mounting slots 46 and a pair of inside mounting slots 48 open rearwardly of the housing for purposes described hereinafter. Finally, housing 36 of each top and bottom connector 32 and 34, respectively, includes a plurality of terminal-receiving passages 50 which extend from the rear of the housing as seen in FIG. 5 and into the interior of receptacle 44 of mating portion 42 as seen best in FIG. 6.

Top connector 32 includes a plurality of terminals, generally designated 52, as best seen in FIG. 5. The terminals have body portions 54 press-fit into terminal-receiving passages 50 of housing 36 of the top connector. The terminals have tail portions 56 which are straight and project rearwardly of the housing. The terminals have contact portions 58 which extend into mating portion 42 and are exposed within receptacle 44 of the top connector for engaging circuit traces on opposite sides of connecting circuit board 20 of the respective mating connector 18.

Bottom connector 34 has a plurality of terminals, generally designated 60, again as best seen in FIG. 5. The terminals have body portions 62 which are press-fit into terminal-receiving passages 50 in housing 36 of the bottom connector. Terminals 60 have contact portions 64 projecting into mating portion 42 of the bottom connector and are exposed within receptacle 44 as seen best in FIG. 6, for engaging circuit traces on connecting circuit board 20 of the respective mating connector. Terminals 60 also have right-angled tail portions 66 for direct insertion into appropriate holes in mother board 12 and for connection, as by soldering, to appropriate circuit traces on the mother board and/or in the holes.

The invention contemplates the use of at least one dual-function ESD frame member, generally designated 68, for supporting connectors 32 and 34 in their stacked array as well as providing an ESD member for the connectors. More particularly, each ESD frame member 68 is stamped and formed of conductive sheet metal material and includes a vertically elongated body portion 70, a pair of integral ESD portions 72 projecting forwardly of the body portion and a pair of dual-function tail portions 74 extending from the bottom of the body member. The frame members also have enlarged flange portions 76 projecting forwardly of the body portions immediately behind ESD portions 72. The flange portions are inserted into outside mounting slots 46 of housings 32 of the top and bottom connectors to mount the connector housings to the ESD frame members. ESD portions 72 of the frame members comprise resilient arms which project forwardly of flange portions 76 into grooves 78 molded on the insides of wing portions 38 of the connector housings. The resilient arms project inwardly of grooves 78 as best seen in FIG. 6 for resiliently engaging a grounding shell on the outside of each mating connector 18. Tail portions 74 of ESD frame members 68 are inserted into appropriate holes in mother board 12 to perform a dual function of mounting the subassembly of FIGS. 4–6 to the mother board as well as grounding the ESD frame members to the circuit board. In other words, tail portions 74 are connected, as by soldering, to appropriate locations on the mother board and/or in the holes.

Another feature of the invention is the provision of a lead frame, generally designated 80, for connecting terminals 52 of top connector 32 to circuit traces on mother board 12. More particularly, lead frame 80 includes a plurality of leads 82 having contact ends 82*a* exposed within a plurality of openings 84 in a plate-like housing 86. The housing may be molded of plastic material and overmolded about the contact ends of leads 82. The leads have tail portions 88 which are insertable into appropriate holes in mother board 12 for connection, as by soldering, to appropriate circuit traces on the board and/or in the holes. Lead frame 80 is connected to terminals 54 of top connector 32 by inserting tail portions 56 of terminals 52 into openings 84 and into engagement with contact ends 82*a* of leads 82. The tail portions of terminals 52 are connected to the contact ends of leads 82 by solder connections, as indicated at 90 in FIG. 5.

A one-piece tail aligner, generally designated 92, includes mounting posts 94 for insertion into appropriate mounting holes in mother board 12. However, the tail aligner is a part of the subassembly shown in FIGS. 4–6 prior to mounting the subassembly to the mother board. The one-piece tail aligner includes two rows of aligning holes 96 for receiving tail portions 88 of leads 82, as well as four rows of aligning holes 98 for receiving tail portions 66 of terminals 60 of the bottom connector. The tail aligner is assembled to those tail portions in the direction of arrow "A" (FIG. 5). The tail aligner is moved upwardly until a chamfered latch flange 100 at each opposite end thereof snaps behind a pair of chamfered latch bosses 102 projecting from the rear of the connector housings as seen in FIG. 5.

Finally, a stamped and formed sheet metal shield, generally designated 104, is positioned about terminals 60 of bottom connector 34 to prevent RF interference or "cross talk" between the terminals of the two connectors. Shield 104 has a front lip 106 with holes 108 at the top of the shield for snapping over a plurality of latch bosses 110 at the top of the bottom connector housing. A pair of apertured side wings 112 of the shield are inserted into the inner mounting slots 48 at the rear of the bottom connector housing. The shield has a pair of tail portions 113 (FIG. 5) inserted into holes in the mother board. The tail portions are connected, as by soldering, to appropriate locations on the mother board.

It should be noted that, although tail aligner 92 and shield 104 do not interengage with housing 36 of the top connector, the housing still is provided with latch bosses 102 and mounting slots 48, because the housings of the two connectors are made identical to each other for efficiency purposes.

In assembly, the subassembly of FIGS. 4–6, including top and bottom connectors 32 and 34, respectively, ESD frame members 68, lead frame 80, tail aligner 92 and shield 104 all are assembled as described above to form the self-contained subassembly. Casing 14 then is mounted over the subassembly by sliding the subassembly into the rear of the casing. Front latch bosses 40 on the outsides of wing portions 38 of the connector housings snap into openings 114 (FIG. 1) in side walls 22 of casing 14. Rear cover 26 then is mounted over the rear of the assembly by sliding the cover down into channels (not shown) on the insides of side walls 22 of casing 14. This subassembly then is mounted on mother board 12 by inserting tail portions 66 of terminals 60 of the bottom connector, tail portions 74 of ESD frame members 68, tail portions 88 of leads 82 of lead frame 80, mounting posts 94 of tail aligner 92 and tail portions 113 of shield 104 into their respective holes in the mother board.

Once the subassembly of FIGS. 4–6 has been mounted and latched within casing 14, a connector position assurance device (CPA) 116 is mounted to the casing by inserting a pair of flat abutment bosses 118 on the CPA through a pair of openings 120 in the casing. The CPA is held in place by a pair of latches 122. The CPA provides a backup device to prevent connectors 32 and 34 from being pushed out of the casing by mating connectors 18. Abutment bosses 118 of the CPA abut behind shoulders 124 (FIG. 4) of housings 36 of connectors 32 and 34.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A system for mounting a plurality of electrical connectors on a printed circuit board in a stacked array with one connector mounted above another connector, comprising:

at least a pair of electrical connectors including at least a top connector and a bottom connector independent of and separate from the top connector, the connectors being mateable with a pair of complementary mating connectors, each top and bottom connector including a plurality of terminals for engagement with appropriate terminal means of the respective mating connector and for connection to the printed circuit board;

an outer EMI casing about said connectors; and at least one dual-function electrostatic discharge (ESD) frame member inside said casing for mounting the top connector to the printed circuit board with the top connector positioned above the bottom connector, the frame member also being conductive for grounding to the printed circuit board and including an integral ESD portion for engaging an appropriate ground portion of a respective one of the mating connectors mateable with the top connector.

2. The system of claim 1 wherein said ESD frame member is stamped and formed of sheet metal material.

3. The system of claim 1 wherein said top connector is elongated, and including a pair of said ESD frame members at opposite ends of the top connector.

4. The system of claim 1 wherein said ESD frame member mounts the bottom connector to the printed circuit board and includes a second integral ESD portion for engaging an appropriate ground portion of a respective one of the mating connectors mateable with the bottom connector.

5. The system of claim 1 wherein said ESD frame member includes at least one dual-function tail portion for insertion into a hole in the printed circuit board for (a) mounting the frame member and the top connector to the circuit board and (b) grounding the frame member to an appropriate ground trace on the circuit board.

6. The system of claim 1 wherein said integral ESD portion of the frame member comprises a resilient arm extending in the mating direction of the top connector.

7. The system of claim 1, including a lead frame for connecting the terminals of the top connector to the printed circuit board.

8. The system of claim 7 wherein said lead frame includes a plurality of leads having contact ends engageable with the terminals of the top connector and terminating ends engageable with the printed circuit board.

9. The system of claim 8 wherein said contact ends of the leads are mounted in a housing of the lead frame.

10. The system of claim 9 wherein said housing is overmolded about the leads at least near the contact ends thereof.

11. The system of claim 9 wherein said housing has a plurality of openings within which the contact ends of said leads are exposed, and the terminals of the top connector have portions extending into the openings for engaging the contact ends of the leads exposed therein.

12. The system of claim 8 wherein said terminating ends of the leads comprise tail portions insertable into holes in the printed circuit board.

13. The system of claim 12 wherein the terminals of the bottom connector have tail portions for insertion into holes in the printed circuit board, and including a common tail aligner for receiving and aligning the tail portions of the terminals of the bottom connector and the tail portions of said leads.

14. A system for mounting a plurality of electrical connectors on a printed circuit board in a stacked array with one connector mounted above another connector, comprising:

at least a pair of elongated electrical connectors including at least a top connector and a bottom connector independent of and separate from the top connector, the connectors being mateable with a pair of complementary mating connectors, each top and bottom connector including a plurality of terminals for engagement with appropriate terminal means of the respective mating connector and for connection to the printed circuit board;

an outer EMI casing about said connectors; and a pair of dual-function electrostatic discharge (ESD) frame members inside said casing at opposite ends of the elongated connectors for mounting the connectors to the printed circuit board with the top connector positioned above the bottom connector, the frame members also being conductive for grounding to the printed circuit board and including integral ESD portions for engaging appropriate ground portions of the mating connectors mateable with the top and bottom connectors.

15. The system of claim 14 wherein said ESD frame members are stamped and formed of sheet metal material.

16. The system of claim 14 wherein the integral ESD portions of the frame members comprise resilient arms extending in the mating direction of the top and bottom connectors.

17. The system of claim 14 wherein each of said ESD frame members includes a pair of dual-function tail portions for insertion into holes in the printed circuit board for (a) mounting the frame members and the top and bottom connectors to the circuit board and (b) grounding the frame members to appropriate ground traces on the circuit board.

18. A system for mounting a plurality of electrical connectors on a printed circuit board in a stacked array with one connector mounted above another connector, comprising:

at least a pair of electrical connectors including at least a top connector and a bottom connector independent of and separate from the top connector, the connectors being mateable with a pair of complementary mating connectors, each top and bottom connector including a plurality of terminals for engagement with appropriate terminal means of the respective mating connector and for connection to the printed circuit board; and a lead frame independent of said connectors for connecting the terminals of the top connector to the printed circuit board, including a housing separate from said connectors and a plurality of leads having contact ends in the housing engageable with the terminals of the top connector and terminating ends engageable with the printed circuit board.

19. The system of claim 18 wherein said housing is overmolded about the leads at least near the contact ends thereof.

20. The system of claim 19 wherein said housing has a plurality of openings within which the contact ends of said leads are exposed, and the terminals of the top connector have portions extending into the openings for engaging the contact ends of the leads exposed therein.

21. The system of claim 18 wherein said terminating ends of the leads comprise tail portions insertable into holes in the printed circuit board.

22. The system of claim 21 wherein the terminals of the bottom connector have tail portions for insertion into holes in the printed circuit board, and including a common tail aligner for receiving and aligning the tail portions of the terminals of the bottom connector and the tail portions of said leads.

* * * * *